US006254410B1

(12) United States Patent
Sugiyama et al.

(10) Patent No.: US 6,254,410 B1
(45) Date of Patent: Jul. 3, 2001

(54) CONNECTOR WITH A PULL-OUT MECHANISM EMPLOYING AIR PRESSURE

(75) Inventors: Masahiko Sugiyama; Yasushi Yoshikawa, both of Shiga-ken (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/314,743

(22) Filed: May 19, 1999

(30) Foreign Application Priority Data

Jul. 6, 1998 (JP) ..... 10-190466

(51) Int. Cl.[7] ..... H01R 13/62
(52) U.S. Cl. ..... 439/158; 439/42
(58) Field of Search ..... 439/158, 42

(56) References Cited

U.S. PATENT DOCUMENTS 1,580,825 * 4/1926 Griffith ..... 439/158
3,249,012 * 5/1966 Clickner, Jr. ..... 89/1.811
3,627,941 * 12/1971 Wrathall ..... 200/51 R
3,835,441 * 9/1974 Harmon ..... 439/184
4,669,791 * 6/1987 Savill ..... 439/34
5,329,693 * 7/1994 Smith ..... 29/764
5,621,197 * 4/1997 Bender et al. ..... 200/61.08

* cited by examiner

*Primary Examiner*—Khiem Nguyen
*Assistant Examiner*—Michael C. Zarroli
(74) *Attorney, Agent, or Firm*—Anthony N. Magistrale; J Bruce Schelkopf

(57) ABSTRACT

Described is a connector in which a plug can be pulled out of a receptacle without producing stress in the connector itself or a circuit board on which the connector is mounted. The plug is inserted into the receptacle so that the side wall of the plug makes contact with the interior wall of the receptacle. When the plug and the receptacle are coupled, a fitting space is formed therebetween. When compressed air is injected into this fitting space, the plug will be pushed up by a rise in the air pressure and therefore the plug can be pulled out of the receptacle. The use of air pressure in the fitting space to pull out the plug is advantageous because it can be implemented without producing biased stress in the plug or the receptacle.

17 Claims, 7 Drawing Sheets

EXHAUST
DURING ENGAGEMENT

AIR
DURING DISENGAGEMENT

EXHAUST
DURING ENGAGEMENT

AIR
DURING DISENGAGEMENT

DURING ENGAGEMENT

DURING DISENGAGEMENT (a)

SECTIONAL VIEW ALONG A-A'

(b)

(a)

SECTIONAL VIEW ALONG C-C'

(b)

(a)

SECTIONAL VIEW ALONG D-D'

(b)

CONNECTOR WITH A PULL-OUT MECHANISM EMPLOYING AIR PRESSURE

BACKGROUND OF THE INVENTION

1. Field of the Invention

The present invention relates to a connector of the type where a plug electrode is fitted into a receptacle electrode, and more particularly to a connector assembly in which a plug can reliably be pulled out of the connector by using air pressure without imposing a load on the connector or a board on which the connector is mounted.

2. Description of Related Art

In personal computers (PCs) and office automation (OA) equipment, a great number of connectors with an array of plugs (i.e., pins) have recently been employed. Such a plug array is used, for example, when electronic devices are connected to a device support circuit board or when an exchange circuit board for an upgrade is connected to a system circuit board. Normally, the plug array is provided in an electronic device or an exchange circuit board, while a receptacle array for receiving the plug array is provided in a device support circuit board or a system circuit board.

With an advancement in the performance and a reduction in the size of PCs or OA equipment, the dimensions of the plug are being reduced while the number of plugs and the density are increasing. As a result, the connector of the type where a plug array is connected to a receptacle array has several problems which need to be solved.

For example, an increase in the number of plugs results in an increase in the force required for inserting and pulling out the plugs. Particularly, a great force is required when a plug array is pulled out of a receptacle array. Therefore, in the case where excessive stress is produced in plugs, receptacles, an electronic device or circuit board on which these are mounted, or a circuit board on which plugs and receptacles are mounted, there is a possibility that they will be damaged. Therefore, for the connector in which the plug is connected to the receptacle, the pull-out operation must be easy without damaging the connector main body or the circuit board.

To facilitate the connection and disconnection between the plug and the receptacle, a method of using a connector incorporated with an auxiliary tool has been proposed. The conventional connector with the auxiliary tool, however, is unsuitable for the environment where an array of high-density plugs is used. Of course, such a connector with an auxiliary tool must not require a large space and it must not be so expensive that the connector cannot be used.

OBJECTS OF THE INVENTION

An object of the present invention is to provide a connector in which the plug can be pulled out of the receptacle without producing stress in the connector itself or a circuit board on which the connector is mounted.

Another object of the present invention is to provide a novel connector assembly which takes advantage of air pressure to pull out the plug array of the receptacle array.

SUMMARY OF THE INVENTION

The connector of the present invention is one in which a receptacle and a plug are coupled together. The plug is inserted into the receptacle so that the side wall of the plug makes contact with the interior wall of the receptacle. When the plug and the receptacle are coupled, a fitting space is formed therebetween. If compressed air is injected into this fitting space, the plug will be pushed up by a rise in the air pressure and therefore the plug can be pulled out of the receptacle. The pullout of the plug by air pressure in the fitting space is advantageous because it can be implemented without producing biased stress in the plug or the receptacle. In other words, the connector of the present invention has no bending of the pin of the connector and also prevents solder cracks and pad land peeling in a circuit board on which the connector is mounted.

In accordance with another embodiment of the present invention, there is provided a connector assembly which includes a first member with an array of plugs and a second member with an array of receptacles disposed so that the plugs can be fitted into the receptacles and a fitting space is formed between the plug and the receptacle. The plug array is disconnected from the receptacle array by injection of compressed air into the fitting spaces.

In accordance with still another embodiment of the present invention, there is provided a connector assembly which includes a first member with an array of plugs and a second member with an array of receptacles. The plug array is pulled out of the receptacle array by expansion of an air tube interposed between the first member and the second member.

BRIEF DESCRIPTION OF THE DRAWINGS

FIG. 5(*b*) is a sectional view taken along cutting plane line A–A' of FIG. 5(*a*).

FIG. 6(*b*) is a sectional view taken along cutting plane line C–C' of FIG. 6(*a*).

FIG. 7(*b*) is a top view of the plug member shown in FIG. 7(*a*).

FIG. 8(*b*) is a side sectional view taken along cutting plane line D–D' of FIG. 8(*a*).

DETAILED DESCRIPTION OF THE INVENTION

Figure 1:
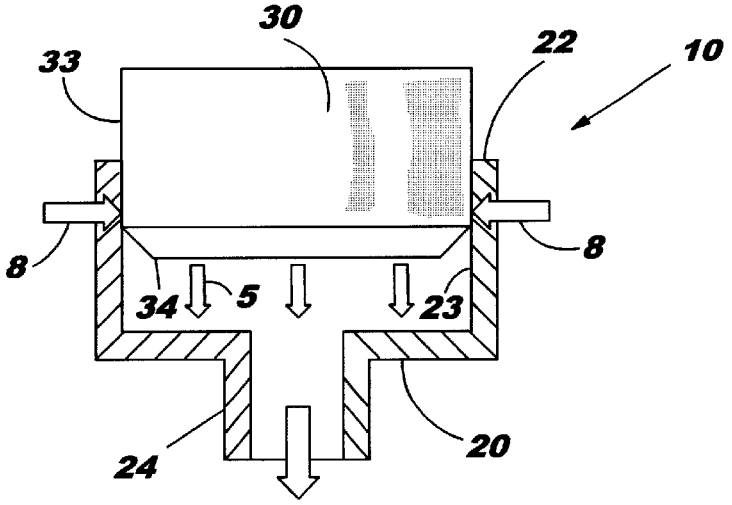
FIG. 1 is a sectional view showing a connector of the present invention in the state in which a plug thereof has been fitted into a receptacle thereof.

FIG. 1 illustrates the basic structure of a connector 10 according to the present invention. The connector 10 of FIG. 1 consists of a single plug 30 and a single receptacle 20. The connector 10 of FIG. 1 corresponds to a single connector portion of a connector assembly having plug and receptacle arrays, described later with reference to FIG. 5.

First, the operation of pulling out the plug 30 by taking advantage of air pressure in accordance with the present invention will be described with reference to FIG. 1. FIG. 1 illustrates the state of the connector 10 in which the plug 30 has been fitted into the receptacle 20. As with many connectors, the plug 30 of the connector 10 of the present invention is slidably inserted into the receptacle 20 and is in contact with the interior wall of the receptacle 20. The plug 30 is pushed into the interior side wall 23 of the receptacle 20 against the elastic force of the interior side wall 23 and is perfectly fitted into the receptacle 20. The size of the side wall 33 of the plug 30 is equal to or slightly larger than that of the interior side wall 23 of the receptacle 20.

The interior side wall 23 of the receptacle 20 and the side wall 33 of the plug 30 are formed so that when the plug 30 is fitted into the receptacle 20, a fitting space 5 is formed therebetween.

When the plug 30 makes contact with the interior side wall 23 of the receptacle 20, it is difficult for air to leak out of the space 5 through the contacting surface between the interior side wall 23 and the side wall 33. Therefore, when the plug 30 is inserted into the receptacle 20, the air in the space 5 is pushed downward by the insertion of the plug 30. The air pushed out by the plug 30 is discharged from the exhaust port of the receptacle 20. This exhaust port is also used as an air injection port for injecting compressed air into the fitting space 5 in order to pull out the plug 30.

Figure 2:
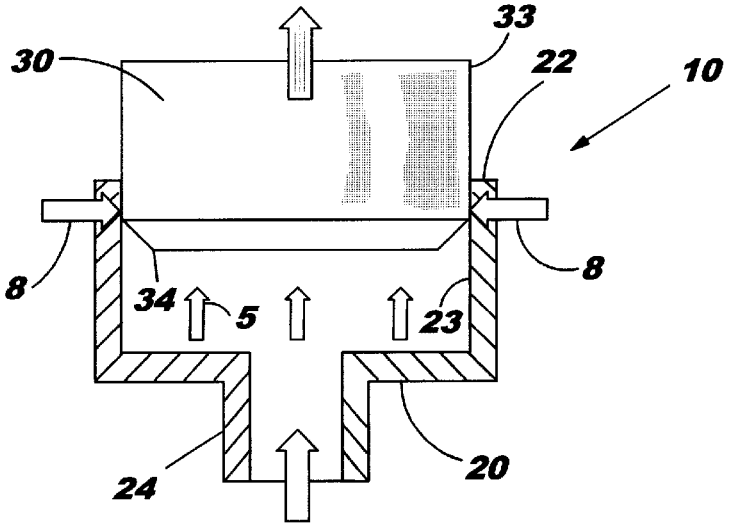
FIG. 2 is a sectional view showing how the plug is pulled out of the receptacle by injecting compressed air into a fitting space.

FIG. 2 illustrates how compressed air is injected from the exhaust port (air injection port) of the receptacle 20 into the fitting space 5 when the plug 30 is pulled out. Normally, the plug 30 is inserted while being slid along the interior side wall 23 of the receptacle 20. In this engagement state, the plug 30 is held in close contact with the receptacle 20 by the radially inward elastic force 8 of the interior side wall 23 of the receptacle 20. In general, the plug 30 inserted in this manner is not easy to pull out of the receptacle 20. In order to facilitate the disengagement, if the plug 30 is pulled out while tension force 6 is being exerted alternately right and left, force will be exerted in the lateral direction and therefore the plug 30 and the receptacle 20 will be damaged.

Such lateral force also causes pad land peeling and solder cracks in a circuit board on which the plug 30 or the receptacle 20 is mounted, as well as an electrical contact defect in the connector 10.

To solve the aforementioned problems, the present invention injects compressed air into the fitting space 5 defined by the receptacle 20 and the plug 30 so that the air pressure is exerted as the force which pushes up the bottom surface of the plug 30. This air pressure also causes the interior side wall 23 of the receptacle 20 to expand radially outward against the radially inward elastic force 8 of the interior side wall 23 of the receptacle 20. When high-pressure air is injected into the fitting space 5, the air pressure acts on the bottom surface 34 of the plug 30 approximately vertically and also acts uniformly on the bottom surface 34. For this reason, the plug 30 can be pulled from the receptacle 20 without causing local strain to occur in the connector 10 and without damaging the main body of the connector 10.

Figure 3:
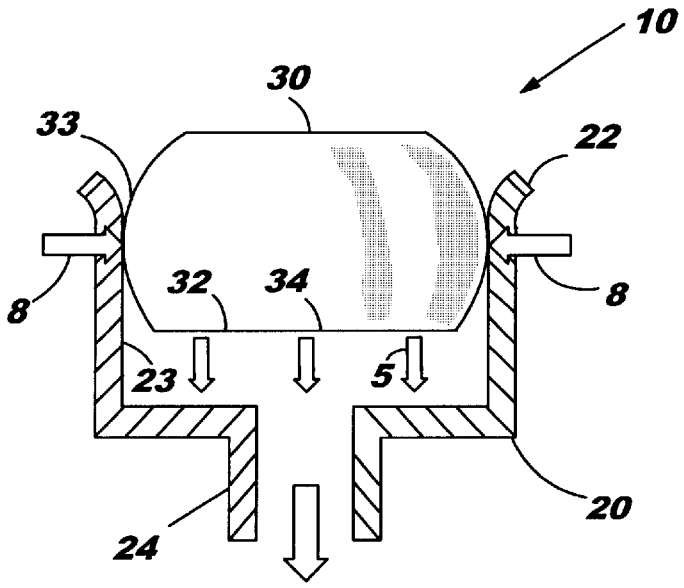
FIG. 3 is a sectional view showing another connector of the present invention in the state in which a plug with a spherical contacting surface has been fitted into a receptacle.

In FIG. 3 there is shown a specific embodiment of the connector 10 of the present invention which makes the pull-out of a plug 30 from a receptacle 20 by air pressure possible. Fitting the plug 30 into the receptacle 20 reliably and stably is the essential requirement of the connector 10. For that reason, the plug 30 is reliably fitted into the receptacle with the radially inward elastic force 8 produced by the interior side wall 23 of the receptacle 20. To facilitate the disengagement of the firmly fitted plug 30 from the receptacle 20 by air pressure, the connector 10 consisting of the plug 30 and the receptacle 20, such as that shown in FIG. 3, is considered. This connector 10 is characterized in that the side surface 33 of the plug 30 which makes contact with the interior side wall 23 of the receptacle 20 is approximately spherical in shape.

The portion of the plug 30 facing the fitting space 5 has a flat bottom surface 34 so that it can receive air pressure uniformly. For the receptacle 20, the upper insertion portion 22 is partially widened so that the spherical plug 30 can be easily inserted into the receptacle 20 with reliability. The interior side wall 23 of the receptacle 20 becomes narrower as it becomes deeper. The side wall 33 (spherical portion) of the plug 30 is slightly larger than the inside diameter of the interior side wall 23 of the receptacle 20. This partial spherical plug 30 is inserted into the receptacle 20 through the upper insertion portion 22 of the receptacle 20. The insertion of the plug 33 is performed against the radially inward elastic force 8 of the interior side wall 23 of the receptacle 20 which increases gradually. The plug 30 in the final engagement state receives the strong inward elastic force 8 from the interior side wall 23 of the receptacle 20 and is therefore held reliably and stably at the contacting point of the side wall 33 on the spherical surface.

Figure 4:
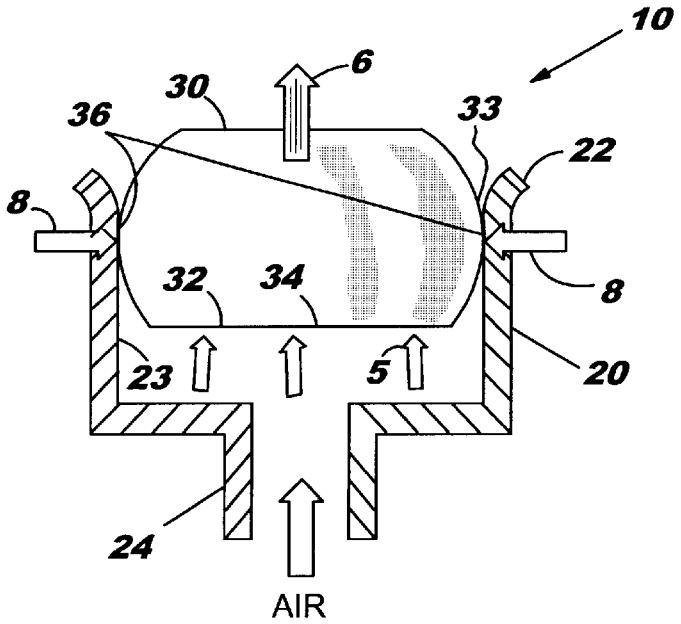
FIG. 4 is a sectional view showing how the plug of FIG. 3 is pulled out of the receptacle by injecting compressed air into a fitting space.

FIG. 4 illustrates the state in which a push-up force is uniformaly exerted on the bottom surface 34 by injecting compressed air into the fitting space 5 defined by the plug 30 and the receptacle 20 coupled together. The diameter size of the contacting point 36 of the interior side wall 23 of the receptacle 20 in contact with the spherical portion 33 of the plug 30 becomes wider as the plug 30 is pushed up. As the contacting point 36 between the plug 30 and the receptacle 20 moves upward, the elastic force 8 of the interior side wall 23 of the receptacle becomes smaller. As a result, the plug 30 is easily pulled out. Finally, as shown in FIG. 4, by injecting compressed air into the fitting space 5, the plug 30 can be pulled out without exerting a biased force on the main body of connector 10, such as the plug 30 and the receptacle 20. Therefore, in the connector 10 shown in FIG. 4, the plug 30 can be prevented from being bent when it is pulled out of the receptacle 20. There is also an advantage that damage, such as solder cracks and pad land peeling in a circuit board on which this connector 10 is mounted, can be prevented.

Figure 5:
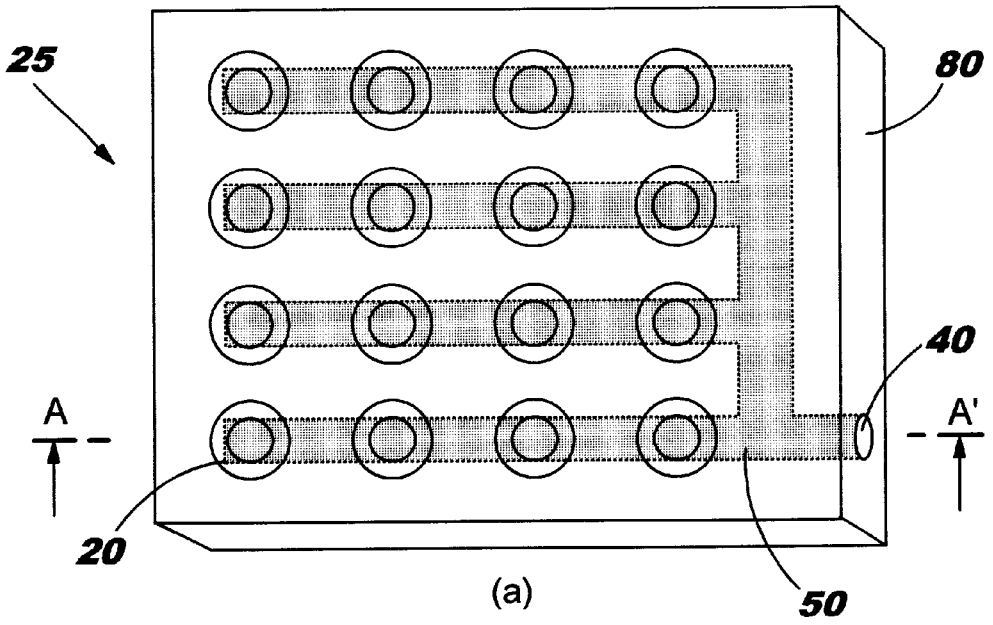
FIG. 5(*a*) is a top view showing the structure of a receptacle member with a plurality of receptacles, each of the receptacles being as shown in FIGS. 1 or 3.
Figure 5:
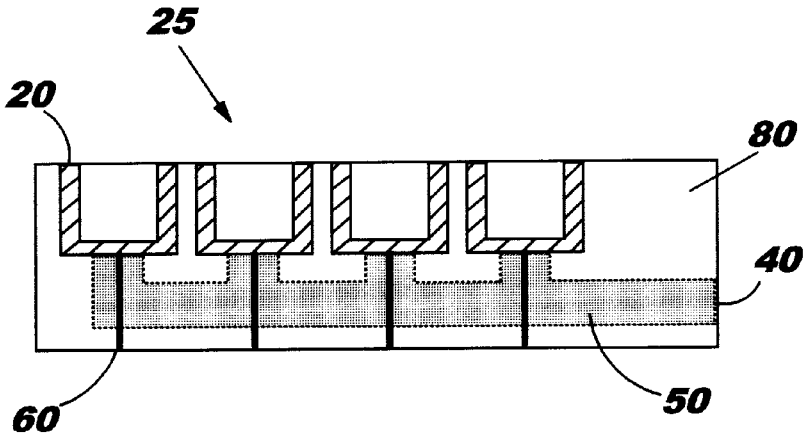

FIG. 5 shows the structure of a receptacle member 25 having an array of receptacles 20, each of the receptacles being as shown in FIGS. 1 or 3. FIG. 5(*a*) shows a top view of the receptacle member 25, while FIG. 5(*b*) shows a sectional view taken along cutting plane line A–A' of FIG. 5(*a*). The receptacle member 25 has an array of receptacles 20 formed in a support body 80. The shaded portions denote air passages 50 formed within the receptacle member 25. In FIG. 5(*a*) which is a top view of the receptacle member 25, the air passages 50 penetrating the interior of the receptacle member 25 are projected. In an embodiment of the receptacle member 25, the air passages 50 are connected with all receptacles 20. The air passages 50 are finally connected to a single air port 40. The present invention is not limited to the single air port 40. For example, a plurality of air ports may be provided if they can give uniform air pressure to each receptacle 20. The heavy line in FIG. 5(*b*) denotes an electrode line 60 provided on the receptacle 20. The present invention is not limited to the layout of the electrode lines 60 shown in FIG. 5, but is applicable to various layouts of the electrode lines 60. The receptacle member 25 (support body 80) of FIG. 5 is mounted, for example, on a support circuit board on which electronic devices are mounted or on a system circuit board on which a circuit board for an upgrade version is mounted.

Figure 6:
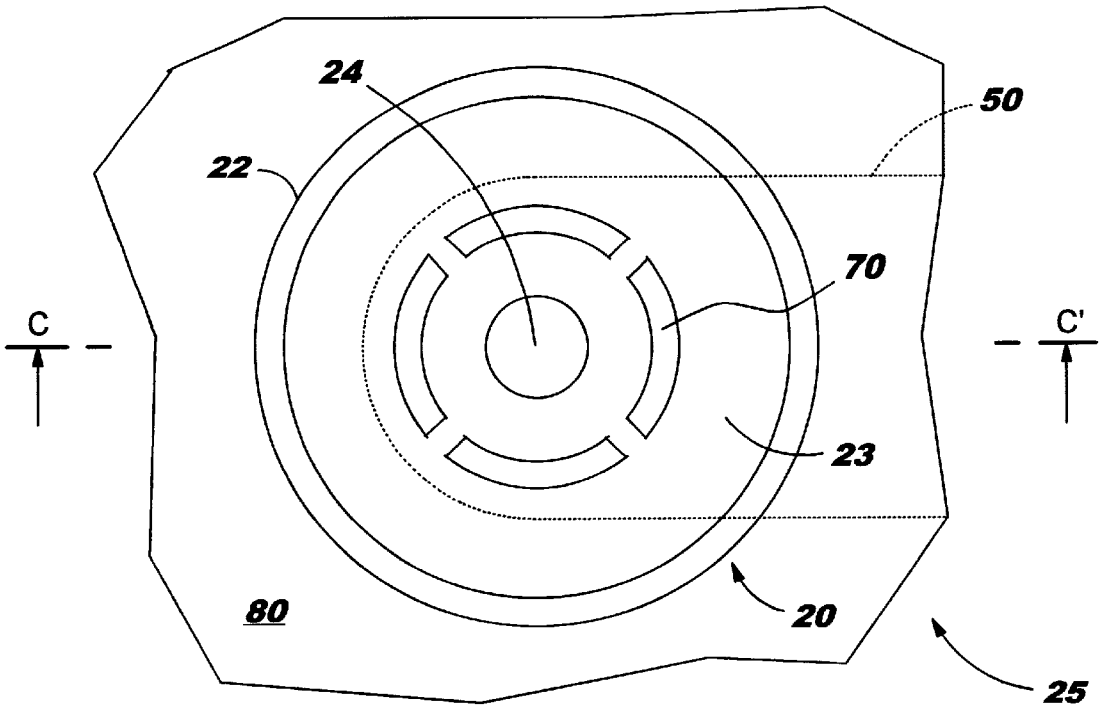
FIG. 6(*a*) is a top view showing an embodiment of the connection between a single receptacle and an air passage.
Figure 6:
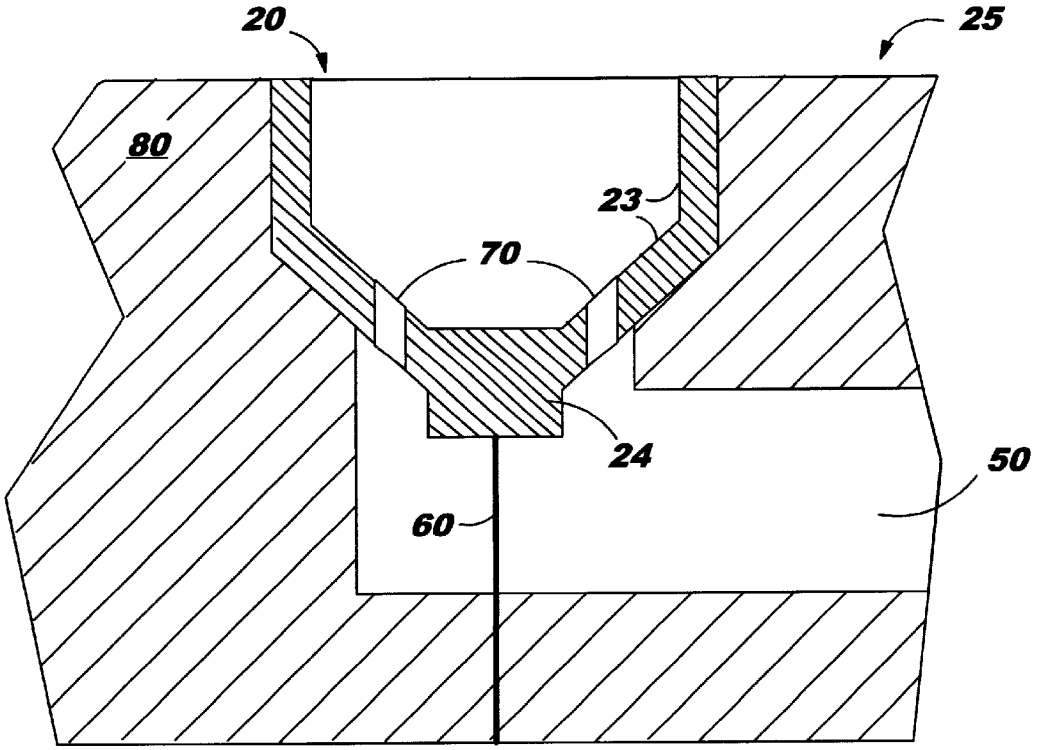

FIG. 6 shows an embodiment of the connection between the receptacle 20 and the air passage 50. FIG. 6(*a*) shows a top view of the receptacle 20, while FIG. 6(*b*) shows a sectional view of the circuit board 80 taken along cutting plane line C–C' of FIG. 6(*a*). The air passage 50 leads to the lower portion 24 of the receptacle 20. The lower portion 24 of the receptacle 20 is provided with air injection holes at portions corresponding to the air passage 50. With these air injection holes, compressed air is supplied to the recess (or fitting space 5) of the receptacle 20 through the air passage 50. For the configuration, layout, and number of the air injection holes, various types can be designed so that a push-up force is uniformly exerted on the bottom surface 34 of the plug 30 fitted into the receptacle 20. The air injection holes 70 are also utilized as exhaust ports through which the air in the fitting space 5 is discharged, when the plug 30 is inserted into the receptacle 20, as described with regard to FIG. 1.

Figure 7:
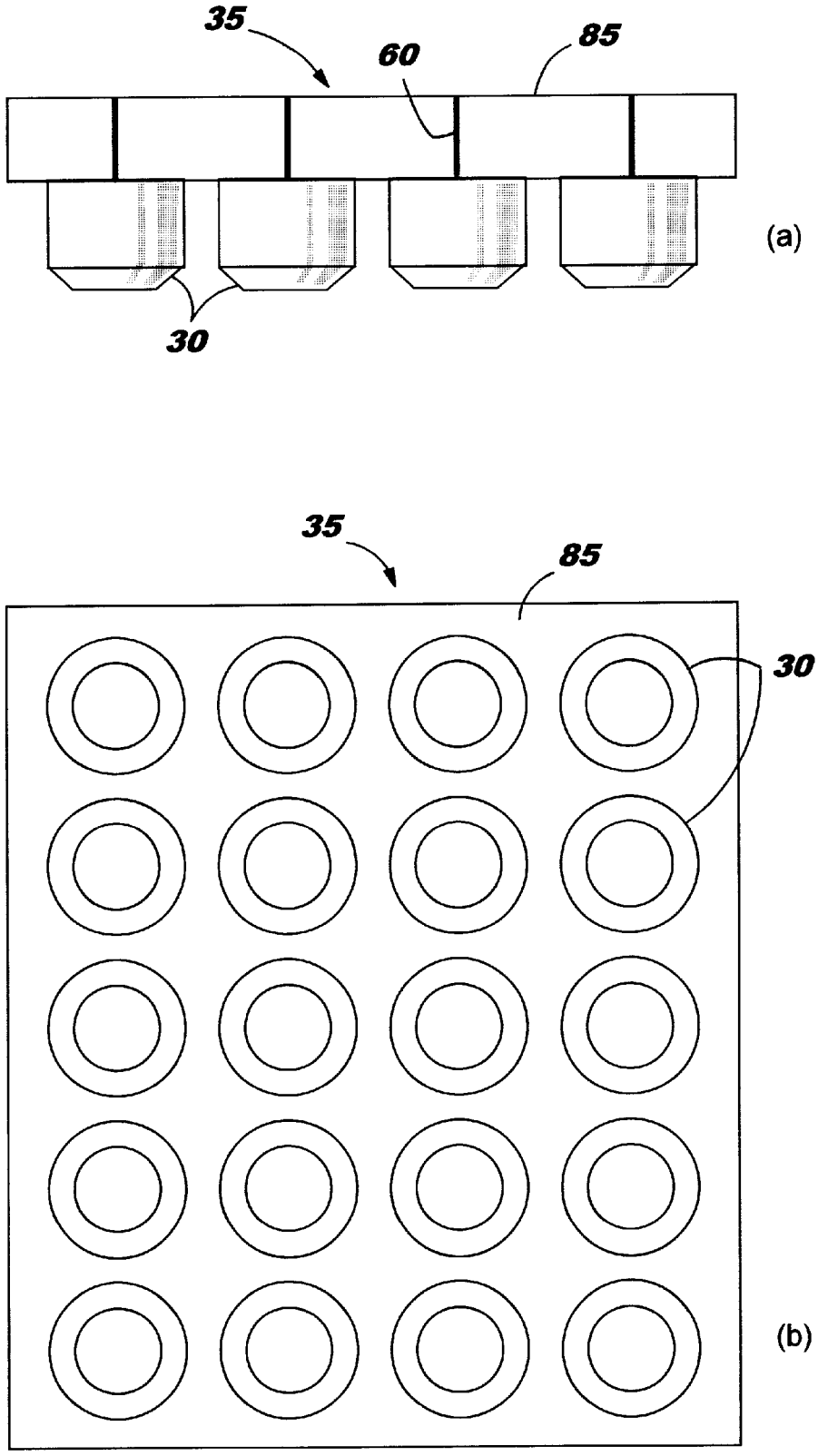
FIG. 7(*a*) is a side view of a plug member with a plurality of plugs.

FIGS. 7(*a*) and 7(*b*) show side and top views of a plug member 35 that are coupled to the receptacle member 25 shown in FIG. 5, respectively. The plug member 35 has an array of plugs 30 formed in a support body 85. The support body 85 may be, for example, an electronic device or an upgrade circuit board. Also, the plug member 35 (support body 85) may be mounted on an electronic device or a circuit board.

When the connector is used, the plug member 35 shown in FIG. 7 is coupled to the receptacle member shown in FIG. 5. In the coupled state, each plug 30 of the plug member 35 forms the aforementioned fitting space 5 in cooperation with the corresponding receptacle 20 of the receptacle member 25. When the plug member 35 is pulled out of the receptacle member 25, as previously described in FIG. 2, compressed air is injected into the fitting space 5. That is, compressed air is fed into all fitting spaces 5 defined by all plugs 30 and receptacles 20 through the air port 40 shown in FIG. 5. The air port 40 communicates with all fitting spaces 5 uniformly through air passages 50 and the air injection holes 70. The compressed air is injected into all fitting spaces 5 through the air injection holes 70 and makes the disengagement of the plugs 30 from the receptacles 20 possible.

The disengagement between the plug member 35 and the receptacle member 25, as with the case of FIG. 2, does not damage the connector 10 (e.g., receptacles 20 and plugs 30). If the plug member 35 and the receptacle member 25 have plugs 30 and receptacles 20 of the same configuration and the same mechanical characteristic, then fitting spaces 5 of the same configuration and the same size will be formed. Therefore, by injecting air of the same pressure into all fitting spaces 5 of the same configuration and size, all plugs 30 can be pulled out of the receptacles 20 at approximately the same time.

Figure 8:
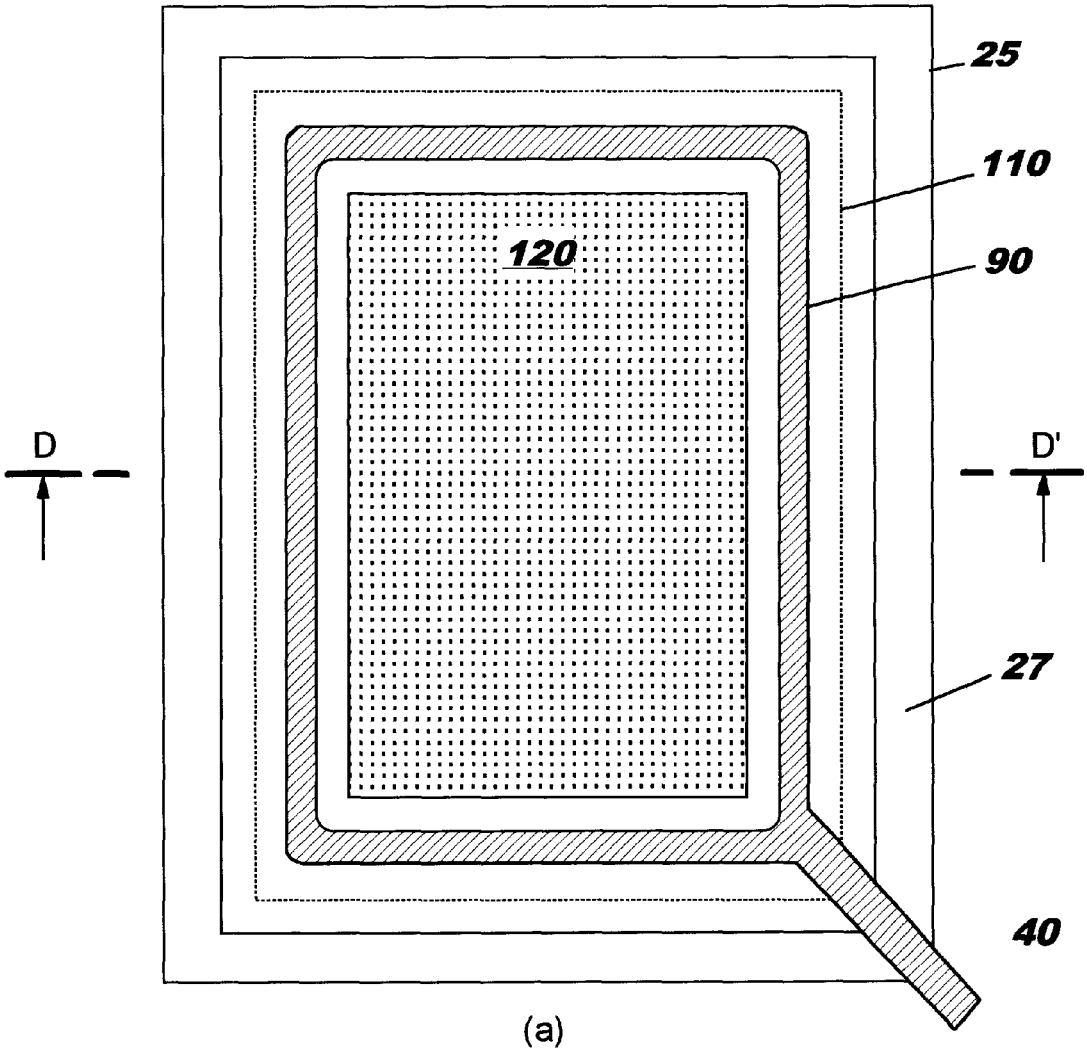
FIG. 8(*a*) is a top view of a receptacle member constituting another connector member of the present invention in which a plug member thereof is pulled out by air pressure injected into an air tube thereof.
Figure 8:
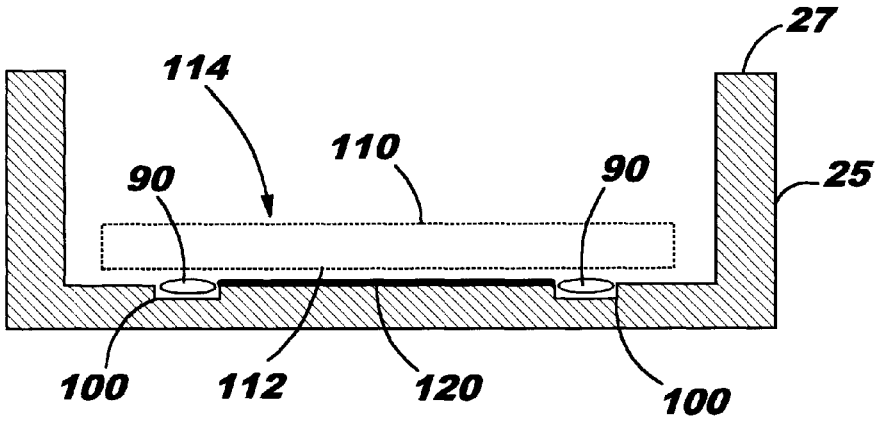
Figure 9:
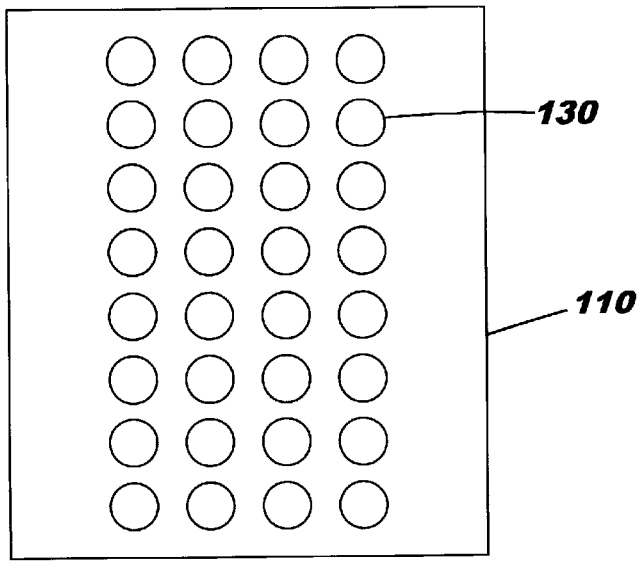
FIG. 9 is a plan view of an auxiliary plate formed with holes through which plugs are passed.
Figure 10:
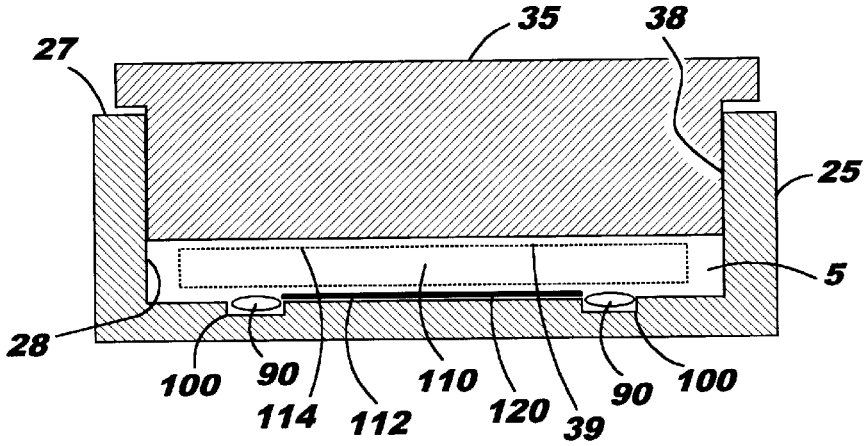
FIG. 10 is a sectional view showing the state in which a plug member has been fitted into the receptacle member that has an air tube and the auxiliary plate.

FIGS. 8 through 10 show another embodiment of the connector assembly that employs both a plug member 35 (FIG. 10) having a plug array and a receptacle member 25 having a receptacle array. FIG. 8(*a*) shows a top view of the receptacle member 25 having a plurality of receptacles 20 (not shown), while FIG. 8(*b*) shows a sectional view taken along cutting plane line D–D'.

The receptacle member 25 has a side wall 27 at its circumference and a receptacle array (indicated at 120) at its bottom portion. An air tube 90 and an auxiliary plate 110 are disposed inside the receptacle member 25. The air tube 90 is housed in a groove 100 in the interior bottom surface of the receptacle member 25. The air tube 90 has an air port 40 (FIG. 8) and protrudes from the receptacle member 25.

The auxiliary plate 110 is interposed between the plug member 35 and the receptacle member 25. More specifically, the plate 110 is interposed between the plug member 35 and the air tube 90. The auxiliary plate 110 has holes 130 formed in correspondence to the positions of plugs 30 so that the plugs 30 can be fitted into the receptacles 20. The size of the holes 130 are larger than that of the plug 30 so that it does not make contact with the side surface 33 of the plug 30. The array of plugs 30 (not shown) mounted on the bottom surface 39 of the plug member 35 is fitted into the array of receptacles 20 provided on an electrode area 120 of the receptacle member 25 by way of the hole 130.

The air tube 90 is a typical tube. It can be made of other expansion materials if they are expandable and contractible by the injection and exhaust of air pressure. The air tube 90 is housed in the groove 100 of the receptacle member 25 except in the case where the plug member 35 is pulled out by expansion of the volume.

FIG. 10 shows the state in which the plug member 35 has been coupled to the receptacle member 25. The plug member 35 is formed so that it can be fitted into the opening defined by the side wall 27 of the receptacle member 25. When the plug member 35 is coupled to the receptacle member 25, the plugs of the plug member 35 are passed through the holes 130 of the auxiliary plate 110 and fitted into the receptacles 20 of the receptacle member 25, respectively. When this occurs, the air tube 90 is housed in the groove 100 and is in its collapsed state.

Figure 11:
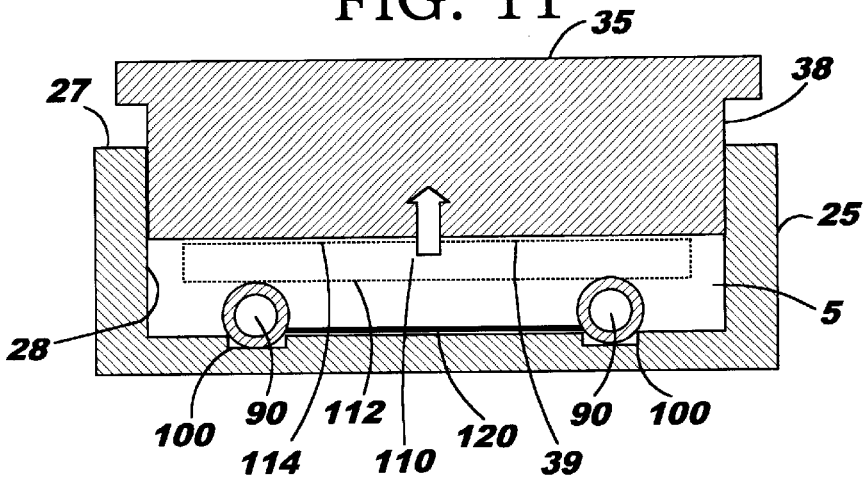
FIG. 11 is a sectional view showing how the plug member is pulled out by the push-up force of air pressure produced when the air tube expands.

FIG. 11 shows how the plug member 35 is pulled out by operation of the air tube 90. When the plug member 35 is pulled out, air is injected through the air port 40. The air tube 90 expands and pushes up the auxiliary plate 110. The pushed auxiliary plate 110 gives a uniform push-up force to the bottom surface 39 of the plug member 35 through the entire surface of the upper surface 114 of the plate 110. At the same time, all plugs 30 of the plug member 35 are pulled out of the receptacles 20 of the receptacle member 25.

The auxiliary plate 110 is preferred because the force produced by the air tube 90 is exerted uniformly on the plug member 35. However, in the case where uniform force can be exerted on the bottom surface 39 of the plug member 35 by the air tube 90 alone, the auxiliary plate 110 can be omitted.

The present invention is not limited to the aforementioned embodiments. Various modifications of the connector in which the plug is pulled out of the receptacle and the connector member in which the plug member is pulled out of the receptacle member can be constructed based on the technical idea that the plug or the plug member is pulled out by air pressure.

What is claimed:

1. A connector assembly comprising:

a first member with an array of plugs;

a second member with an array of receptacles disposed such that said plugs can be fitted into said receptacles;

wherein said plugs are inserted into said receptacles so that a side wall of each of said plugs makes contact with an interior wall of a corresponding receptacle so as to define an array of fitting spaces between said plugs and said receptacles; and wherein compressed air is injected into said array of fitting spaces to push up said plugs so that said plugs can be pulled out of said receptacles.

2. The connector assembly according to claim 1, wherein said receptacles have air injection holes for introducing said compressed air into said fitting spaces, respectively, and wherein said compressed air is injected simultaneously into all of said fitting spaces through said air injection holes.

3. The connector assembly according to claim 2, wherein an air passage equally communicating with said air injection holes is formed in said second member.

4. The connector assembly according to claim 1, wherein said first member forms part of a circuit board or an electronic device.

5. The connector assembly according to claim 1, wherein said first member is mounted on a circuit board or an electronic device.

6. The connector assembly according to claim 1, wherein said second member is mounted on a circuit board or an electronic device.

7. The connector assembly according to claim 4, wherein said second member is mounted on a circuit board or an electronic device.

8. The connector assembly according to claim 5, wherein said second member is mounted on a circuit board or an electronic device.

9. A connector assembly comprising:

a first member with an array of plugs;

a second member with an array of receptacles disposed so that said plugs can be fitted into said receptacles;

an air tube arranged on a surface of said second member which faces said first member;

an air port connected to said air tube for feeding air into said air tube; and wherein compressed air is injected through said air port to expand said air tube in a space between said first and second members, and said first member is pushed up by the expansion force so that said plugs can be pulled out of said receptacles.

10. The connector assembly according to claim 9, wherein said air tube is housed in a groove in a surface of said second member when said tube is constructed.

11. The connector assembly according to claim 9, wherein an auxiliary plate with openings for passing said plugs therethrough is interposed between said air tube and said first member and provides a uniform push-up force produced by the expansion of said air tube to a bottom surface of said first member.

12. The connector assembly according to claim 10, wherein an auxiliary plate with openings for passing said plugs therethrough is interposed between said air tube and said first member and provides a uniform push-up force produced by the expansion of said air tube to a bottom surface of said first member.

13. The connector assembly according to claim 9, wherein said first member forms part of a circuit board or an electronic device.

14. The connector assembly according to claim 9, wherein said first member is mounted on a circuit board or an electronic device.

15. The connector assembly according to claim 9, wherein said second member is mounted on a circuit board or an electronic device.

16. The connector assembly according to claim 13 wherein said second member is mounted on a circuit board or an electronic device.

17. The connector assembly according to claim 14 wherein said second member is mounted on a circuit board or an electronic device.

* * * * *